252-95 AU 165 EX
6/22/76 OR 3,965,024

United States Patent [19]
Schmadel et al.

[11] 3,965,024
[45] June 22, 1976

[54] WASHING AGENT COMPOSITIONS AND WASHING ASSISTANT COMPOSITION CONTAINING PHOSPHONOPOLYCARBOXYLATE SEQUESTERING AGENTS

[75] Inventors: Edmund Schmadel, Mettman; Günter Jakobi, Hilden; Karl-Heinz Worms; Helmut Blum, both of Dusseldorf-Holthausen, all of Germany

[73] Assignee: Henkel & Cie G.m.b.H., Dusseldorf-Holthausen, Germany

[22] Filed: Nov. 21, 1973

[21] Appl. No.: 417,891

[30] Foreign Application Priority Data

Nov. 29, 1972 Germany ..... 2258301

[52] U.S. Cl. ..... 252/95; 252/89 R; 252/135; 252/545; 252/546; 252/DIG. 1; 252/DIG. 11; 252/DIG. 17

[51] Int. Cl.[2] ..... C11D 3/395

[58] Field of Search ..... 252/89, 97, 99, DIG. 17, 252/95, 96, 98, 109, 121, 135, 180, 181, 523, 525, 526, 527, 529, 531, 535, 539, 544, 545, 546, 548, DIG. 1, DIG. 11, DIG. 12, DIG. 17; 260/502.4 R, 502.4 A, 502.4 P, 502.5

[56] References Cited

UNITED STATES PATENTS

| | | | |
|---|---|---|---|
| 3,400,148 | 9/1968 | Quimby | 252/89 X |
| 3,451,937 | 6/1969 | Quimby | 252/89 X |
| 3,562,166 | 2/1971 | Nicholson et al. | 252/89 X |
| 3,562,169 | 2/1971 | Prentice | 252/89 X |

FOREIGN PATENTS OR APPLICATIONS

| | | | |
|---|---|---|---|
| 2,141,983 | 3/1973 | Germany | 252/89 |

*Primary Examiner*—Thomas J. Herbert, Jr.
*Assistant Examiner*—Bruce H. Hess
*Attorney, Agent, or Firm*—Hammond & Littell

[57] ABSTRACT

Washing agent compositions and washing assistant compositions containing from 0.5% to 70% by weight of a phosphonopolycarboxylate having the formula

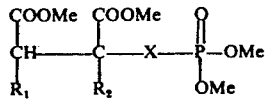

wherein Me is H, alkali metal, or $H.NR_3$, $R_1$ is H or $CH_3$, $R_2$ is H, alkyl having 1 to 4 carbon atoms or $—CH_2—CHR—COOMe$, $R_3$ is H, alkyl or alkylol having 1 to 6 carbon atoms, and X is a direct bond or the groups

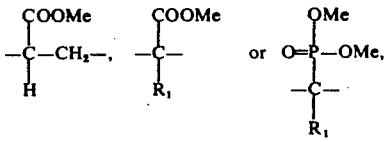

from 0 to 96.5% of other sequestering and non-sequestering, preferably phosphorus-free builders, and from 3% to 45% by weight of at least one surface-active compound of an anionic or non-ionic nature, whereby a 1% aqueous solution thereof has a pH of between 6 and 11.5. Preferably said phosphonopolycarboxylate sequestering agents are present as water-soluble salts capable of complex formation with alkaline earth metal ions. The invention also resides in the process of sequestering alkaline earth metal ions using aqueous solutions of the washing agent composition.

12 Claims, No Drawings

WASHING AGENT COMPOSITIONS AND WASHING ASSISTANT COMPOSITION CONTAINING PHOSPHONOPOLYCARBOXYLATE SEQUESTERING AGENTS

THE PRIOR ART

The action of the known washing agent compositions and washing assistant compositions is based to a substantial part on the presence of inorganic or organic sequestering agents for alkaline earth metal ions. These sequestering agents support the effect of other non-sequestering inorganic or organic cleaning substances. To such sequestering agents belong, for example, sodium tripolyphosphate. The use of this sequestering agent in washing agent compositions and washing assistants has been criticized publicly in connection with questions of ecology. Frequently, an opinion has been expressed that the eutrophication of lakes is derived largely from the phosphorus-containing compounds that come through such washing agent compositions into the waters. Therefore, a demand has been made for washing agent compositions with a low content of phosphorus.

OBJECTS OF THE INVENTION

An object of the invention is to replace the known phosphorus-containing sequestering agents in washing agent compositions and washing assistant compositions by active sequestering agents that contain phosphorus in a very much lower amount and possess beyond that a good sequestering power equal to an equal amount of sodium tripolyphosphate.

A further object of the present invention is the development of washing agent compositions and washing assistant compositions comprising (a) from 0.5% to 70% by weight of a phosphonopolycarboxylate having the formula

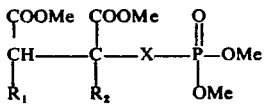

wherein $R_1$ is a member selected from the group consisting of hydrogen and methyl, $R_2$ is a member selected from the group consisting of hydrogen, alkyl having 1 to 4 carbon atoms and $—CH_2—CHR_1—COOMe$, X is a member selected from the group consisting of (1) a direct bond between the carbon and the phosphorus,

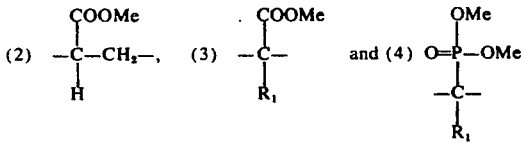

and Me is a member selected from the group consisting of hydrogen and a cation capable of complex formation with alkaline earth metal ions, (b) from 0 to 96.5% by weight of customary non-surface-active ingredients for washing agents and (c) from 3% to 45% by weight of at least one surface-active compound selected from the group consisting of anionic surfaceactive compounds and non-ionic surface-active compounds.

A yet further object of the present invention in the development in the process of washing and cleansing solid materials which comprises contacting solid materials having soil thereon with an aqueous solution containing from 0.5 to 80 gms/liter of a cleansing agent consisting of from 30% to 99.5% by weight of at least one compound having a cleaning action and from 70% to 0.5% by weight of a sequestering agent capable of sequestering alkaline earth metal ions, for a time sufficient to disperse and dissolve said soil in said aqueous solution and removing said cleansed solid materials, the improvement consisting of utilizing, as said sequestering agent, at least one phosphonopolycarboxylate sequestering agent capable of sequestering alkaline earth metal ions having the formula

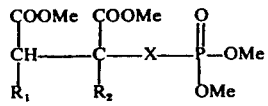

wherein $R_1$ is a member selected from the group consisting of hydrogen and methyl, $R_2$ is a member selected from the group consisting of hydrogen, alkyl having 1 to 4 carbon atoms and $—CH_2—CHR_1—COOMe$, X is a member selected from the group consisting of (1) a direct bond between the carbon and the phosphorus,

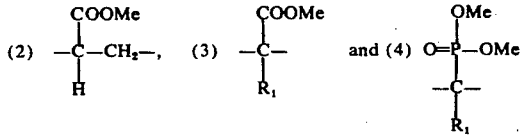

and Me is a member selected from the group consisting of hydrogen and a cation capable of complex formation with alkaline earth metal ions.

These and other objects of this invention will become more apparent as the description thereof proceeds.

DESCRIPTION OF THE INVENTION

This invention relates to washing agent compositions or washing assistant compositions, containing sequestering agents for alkaline earth metal ions, being present as solids, pastes, dispersions or solutions containing as a low phosphoruscontaining sequestering agent, at least one phosphonopolycarboxylic acid of the formula I

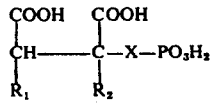

(I)

or water-soluble salts thereof, where $R_1$ denotes a hydrogen or methyl, $R_2$ a hydrogen, an alkyl with 1 to 4 carbon atoms, or the radical $—CH_2—CHR_1—COOH$, and X is a direct bond or the group

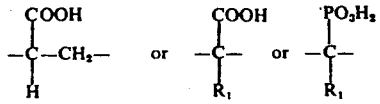

where preferably a maximum of three carboxyl groups are present.

The phosphonopolycarboxylic acids of formula I and their water-soluble salts, hereafter called "phosphonopolycarboxylic acids", "phosphonopolycarboxylates" or "PPC", are the free acids and those compounds where the hydrogen of the phosphonic acid group or groups and of the carboxyl groups is substituted completely or partly by an alkali metal, particularly sodium, or by ammonium. The water-soluble salts with organic bases, particularly with aliphatic amines and alkylolamines with not more than 6 carbon atoms in the molecule, can also be used.

PPC can represent the sole builder. It can also be used in combination with alkaline-reacting salts which have little or no sequestering power for alkaline earth metal ions to prevent the precipitation of alkaline earth metal salts.

The washing agent compositions and washing assistant compositions according to the invention are characterized in that they contain:

0.5% to 70% by weight of a phosphonopolycarboxylic acid of the above defined formula I 0 to 96.5% by weight of other sequestering and nonsequestering, preferably phosphorus-free builder salts.

3% to 45% by weight of at least one surface-active compound of the groups of soaps, synthetic carboxylates, sulfates, sulfonates and of the non-ionic polyglycolethers, where the constituents of the washing agent compositions and washing assistant compositions, particularly the phosphonopolycarboxylic acid and other builder salts, are so selected that the preparations have a pH value in a 1% aqueous solution of between 6 and 11.5, preferably between 7 and 11.

Preferably, the invention consists of washing agent compositions and washing assistant compositions comprising (a) from 0.5% to 70% by weight of a phosphonopolycaboxylate having the formula

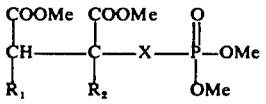

wherein $R_1$ is a member selected from the group consisting of hydrogen and methyl, $R_2$ is a member slected from the group consisting of hydrogen, alkyl having 1 to 4 carbon atoms and $—CH_2—CHR_1—COOMe$, X is a member selected from the group consisting of (1) a direct bond between the carbon and the phosphorus,

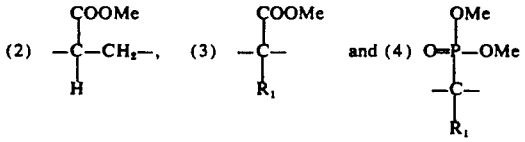

and Me is a member selected from the group consisting of hydrogen and a cation capable of complex formation with alkaline earth metal ions. More particularly, the phosphonocarboxylate has a maximum of three carboxyl groups in the molecule. Me is selected from the group consisting of hydrogen, alkali metal and $H.NR_3$ where $R_3$ is selected from the group consisting of hydrogen, alkyl having 1 to 6 carbon atoms and alkylol having 2 to 6 carbon atoms, and the pH of a 1% aqueous solution of the compositions is between 6 and 11.5, preferably between 7 and 11.

The preparations according to the invention contain in addition other known washing agent components, such as a bleaching component, textile softeners, optical brighteners, soil suspension agents, foam regulators, enzymes, dyes and perfumes, and water. Suitable according to the invention are, for example, the following phosphonopolycarboxylic acids:

1-phosphonoethane-1,2-dicarboxylic acid
2-phosphonopropane-2,3-dicarboxylic acid
1-phosphonopropane-1,2,3-tricarboxylic acid
1-phosphonopropane-1,2-dicaboxylic acid
1-phosphono-2-methyl-propane-1,2,3-tricarboxylic acid
2-phosphonobutane-2,3-dicarboxylic acid
2-phosphonobutane-2,3,4-tricarboxylic acid
2-phosphonobutane-1,2,4-tricarboxylic acid
1-phosphonobutane-1,2,3-tricarboxylic acid
1-phosphono-2-methyl-butane-1,2,3-tricarboxylic acid
2-phosphono-3-methyl-butane-2,3,4-tricarboxylic acid
2-phosphonopentane-2,3,4-tricarboxylic acid
2-phosphono-3-methyl-pentane-2,3,4-tricarboxylic acid
1,1-diphosphonopropane-2,3-dicarboxylic acid
1,1-diphosphono-2-methyl-propane-2,3-dicarboxylic acid
2,2-diphosphonobutane-3,4-dicarboxylic acid
1,1-diphosphonobutane-2,3-dicarboxylic acid
2,2-diphosphono-3-methyl-butane-3,4-dicarboxylic acid
2,2-diphosphonopentane-3,4-dicarboxylic acid
1,1-diphosphono-2-methyl-butane-2,3-dicarboxylic acid
2,2-diphosphono-3-methyl-pentane-3,4-dicarboxylic acid.

The phosphorus content of the phosphonopolycarboxylic acids to be used according to the invention is mostly less than half the phosphorus content of an equal amount of sodium tripolyphosphate, based on the sodium salts. In the washing agent compositions, according to the invention, the total phosphorus content depends on whether the lowphosphorus builder component of these compositons consists of PPC alone or of a combination of PPC with other builders, preferably alkali metal carbonates and/or silicates. The phosphorus content of the compositions according to the invention is not more than 4% by weight, preferably not over 2% by weight. It is thus less than 2/5, mostly less than 1/5 of the total phosphorus content of a comparable detergent containing sodium tripolyphosphate.

Preferably the low phosphorus builder component of the composition according to the invention contains PPC together with alkali metal carbonates and/or silicates whereby the weight ratio of PPC to carbonates and/or silicates is between 1:100 and 4:1, preferably between 1:50 and 4:1, and particularly between 1:20 and 1:1.

The composition of the washing agent compositions and washing assistant compositions according to the invention depends to a great extent on their use. Products according to the invention, which are to be used as soaking agents and those which are to be used as prewashing agents have, as a rule, like the high-temperature universal or full washing agents, a pH of between 9.5 and 11 in 1% aqueous solution. This is mostly achieved by a higher content of alkaline-reacting builder salts. Products which are used as fine or low temperature washing agents are usually neutral to weakly alkaline in 1% aqueous solution (pH 9.5), but sometimes also weakly acid (pH 6–7). The high temperature or universal or full washing agents also differ from the other preparations by their content of a bleaching component consisting of peroxide compounds, stabilizers and activators, if necessary. The bleaching component can represent 10% to 50% by weight, preferably 15% to 40% by weight of the entire composition.

Of particular importance in practice are the low foaming washing agents used preferably in washing machines, where the surface-active component has the following composition:

8% to 95%, preferably 25% to 75%, by weight of anionic surface-active compounds of the sulfonate and/or sulfate type, 0% to 80%, preferably 10% to 50%, by weight of soap, including a portion of low-foaming soap of saturated fatty acids with 20 to 24 carbon atoms, where the quantitative ratio (sulfonate + sulfate):-soap is 10:1 and 1:10, preferably between 5:1 and 1:2, 0% to 80%, preferably 5% to 40%, by weight of non-ionic surface-active compounds, 0% to 6%, preferably 0.5% to 3%, by weight of foam stabilizers, 0% to 8%, preferably 0.5% to 5%, by weight of non-surface-active foam inhibitors, where the foaming power of the surface-active component is reduced by the presence of at least one foam inhibitor (low foaming soap and/or non-surface-active foam inhibitor).

Washing agent compositions according to the invention which contain the above-mentioned surface-active components can correspond, for example, to the following recipes:

A. Full washing agent 0.5% to 40% by weight of PPC

5% to 60% by weight of other builder salts

8% to 35% by weight of surface-active components

10% to 40% by weight of bleaching components

1% to 5% by weight of magnesium silicate, and up to 15% by weight of other customary constituents.

B. Prewashing agents:

0.5% to 30% by weight of PPC

10% to 70% by weight of other builder salts

3% to 10% by weight of surface-active components, and up to 15% by weight of other customary ingredients.

C. Fine and low-temperature washing agents:

3% to 30% by weight of PPC

10% to 60% by weight of other builder salts

10% to 40% by weight of surface-active components, and up to 15% of other customary ingredients.

The present invention, therefore, also includes in the process of washing and cleansing solid materials which comprises contacting solid materials having soil thereon with an aqueous solution containing from 0.5 to 80 gms/liter of a cleansing agent consisting of from 30% to 99.5% by weight of at least one compound having cleaning action and from 70% to 0.5% by weight of a sequestering agent capable of sequestering alkaline earth metal ions, for a time sufficient to disperse and dissolve said soil in said aqueous solution and removing said cleansed solid materials, the improvement consisting of utilizing, as said sequestering agent, a least one copolymer-carboxylate sequestering agent capable of sequestering alkaline earth metal ions having the formula

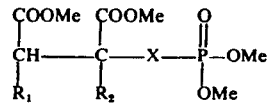

wherein $R_1$ is a member selected from the group consisting of hydrogen and methyl, $R_2$ is a member selected from the group consisting of hydrogen, alkyl having 1 to 4 carbon atoms and $—CH_2—CHR_1—COOMe$, X is a member selected from the group consisting of (1) a direct bond between the carbon and the phosphorus,

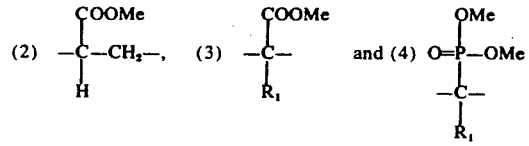

and Me is a member selected from the group consisting of hydrogen and a cation capable of complex formation with alkaline earth metal ions.

The soaking, prewashing, fine-washing, washing and bleaching agent compositions, according to the invention, containing phosphonopolycarboxylates, can be used with textiles derived from the most varied fibers of natural or synthetic origin. To them belong, for instance, cotton, viscose or linen as well as textiles, that contain highly processed cotton or synthetic fibers, such as polyamide, polyester, polyacrylonitrile, polyurethane, polyvinyl chloride or polyvinylidene chloride fibers. The washing agent compositions of the invention can also be used for laundering of textiles, designated as "easy care", occasionally also as "no-iron", of synthetic fiber-cotton-mixed fabrics.

The sequestering power of the phosphonopolycarboxylic acids is particularly pronounced with respect to the alkaline earth metals, so that they can support and enhance the washing and cleansing processes. On the other hand, their sequestering power for heavy metals is, likewise as in other known sequestering builders, only slight. It is, therefore, recommended to add to the washing agents, according to the invention, such sequestering agents for heavy metals in slight amounts of, for instance, from 0.1% to 5%, preferably 0.1% to 2% by weight. As sequestering agents for heavy metals, particularly for copper, for instance, ethylenediaminetetraacetic acid, diethylenetriaminepentaacetic acid or hydroxyethane-diphosphonic acid or their salts are suitable.

The other customary ingredients of the above recipes A to C are the following components, of which at least one is contained in the washing agents according to recipes A to C in the indicated quantities:

0.1% to 5% by weight of a sequestering agent for heavy metals, 0.2% to 3% by weight of a soil suspension agent, 0.7% to 3% by weight of enzymes, 2% to 8% by weight of a textile softener, 0.1% to 1% by weight of an optical brightener, 0.01% to 1% by weight of dyes and perfumes, 0.2% to 2% by weight of antimicrobial compounds, 0 to 15% by weight of water.

The washing agent compositions and washing assistant compositions according to the invention containing phosphonopolycarboxylic acids of formula I are characterized, in the washing of textiles of various fibers of natural or synthetic origin, by insensitivity to water hardness, even at high temperatures, and by excellent washing power. A particular advantage of the builder sequestering agents used according to the invention is their insensitivity under conditions where sodium tripolyphosphate is already partly or completely hydrolyzed. This insensitivty of the phosphonopolycarboxylic acids to be used according to the invention is of particular importance in the production most widely used today for solid detergents and washing aids, namely, the hot-drying of a paste-like aqueous solution of the ingredients.

The solid washing agents according to the invention are mostly available as flowable products in the form of powders, granules, agglomerates or hollow beads. However, they can also be present in many other forms, for example, as rods, needles or flakes.

The most widely used method for the production of the powders is spray-drying. The components, which are present at first in the form of a powder or aqueous solution, are mixed to a slurry or solution. This mixture is sprayed in a drying tower through nozzles into a hot air current. The powder thus produced is mixed subsequently with other powdered washing agent components, if necessary, which are less suitable for spray-drying, such as the bleaching component, for example. Individual washing agent ingredients can also be sprayed on the powders obtained in the production of the detergents. Thus, for example, the non-ionic surfaceactive compounds are frequently not added to the slurry, but sprayed on a powdered washing agent component. This procedure is particularly recommended for the non-surface-active foam inhibitors which are sprayed preferably on a finished powder.

All other methods for the producton of flowable washing agent compositions can be used as long as they ensure the composition of the washing agents according to the invention.

In the following, the ingredients contained in the washing, rinsing and cleansing agent compositions according to the invention, as arranged by substance classes, are described more particularly.

The tensides or surface-active components in the washing agent composition or washing assistant composition of the invention contain in the molecule at least one hydrophobic organic residue and at least one anionic or non-ionic water-solubilizing group. The preferably saturated hydrophobic residue is mostly aliphatic, of mostly 8 to 26, preferably 10 to 22 and especially 12 to 18, carbon atoms, or possibly also an alkyl aromatic residue with 6 to 18, preferably 8 to 16, aliphatic carbon atoms. It may be combined directly with the water-solubilizing groups or through intermediate members, such as through benzene rings, carboxylic acid ester links, carbonamide links or sulfonic-acid amide links as well as through ester- or ester-like residues of polyhydric alcohols.

Soaps, which are derived from natural or synthetic fatty acids, possibly also from resin acids or naphthenic acids, are utilizable as anionic detergent substances, especially if these acids have iodine values of not more than 30 and preferably less than 10.

Among the synthetic anionic tensides, the sulfonates and sulfates possess particularly practical importance.

The sulfonates include, for example, alkylbenzenesulfonates with preferably straight-chain $C_{9-15}$, especially $C_{10-14}$ alkyl residues, alkanesulfonates, obtainable from preferably saturated aliphatic $C_{8-18}$, especially $C_{12-18}$ hydrocarbons by sulfochlorination or sulfoxidation or by the additions of bisulfite to an olefin, mixtures of alkanesulfonates, hydroxyalkanesulfonates and alkanedisulfonates, know under the name of "olefinsulfonates", which are formed by acidic or alkaline hydrolysis of the sulfonation products which first result from terminal or non-terminal $C_{15-18}$ and preferably $C_{12-18}$ olefins by sulfonation with sulfur trioxide. The sulfonates, utilizable according to the invention, include also salts, preferably alkali metal salts of $\alpha$-sulfo fatty acids and salts of esters of these acids with mono or polyhydric alcohols with 1 to 4, and preferably 1 to 2 carbon atoms.

Preferable are the carboxylate esters of $\alpha$-sulfo, hydrogenated, coconut fatty acids, palm kernel fatty acids or tallow fatty acids with methanol or ethanol.

Tensides of the sulfate type include primary fatty alcohol monosulfates, especially those derived from coconut fatty alcohols, tallow fatty alcohols or from oleyl alcohol, are those of secondary alkanols having 9 to 26 carbon atoms. Also suitable are sulfatized fatty acid alkylolamides or fatty acid monoglycerides and sulfated alkoxylation products of alkylphenols ($C_{8-15}$ alkyl), primary fatty alcohols, or secondary alkanols with 1 to 4 ethylene glycol residues in the molecule.

An anionic tensides of the carboxylate type, for example are the fatty acid esters or amides of hydroxycarboxylic acids and aminocarboxylic acids or hydroxysulfonic acids and aminosulfonic acids, such as the condensations of fatty acids with sarcosine, glycollic acid, lactic acid and taurides or isethionates.

The anionic tensides are mostly present as salts of the alkali metals, particularly of sodium or potassium, as well as the ammonium salts and salts of alkylamines or alkylolamines having 1 to 6 carbon atoms such as mono, di or triethanolamine.

The nonionic tensides, for the sake of simplicity called hereafter "Nonionics", include the polyethyleneglycol ethers, obtained by addition of from 4 to 40, preferably 4 to 20 mols of ethylene oxide to 1 mol of fatty alcohols, alkylphenols, fatty acids, fatty amines, fatty acid amides or alkane sulfonic acid amides. Particularly important are the addition products of 5 to 16 mols of ethylene oxide adducted onto lauryl or stearyl alcohols, oleyl alcohol, or onto secondary alkanols with 8 to 18, preferably 12 to 18 carbon atoms, as well as on monoalkylphenols or dialkylphenols with 6 to 14 carbon atoms in the alkyls. In addition to these water-soluble non-ionics, also of interest are polyglycol ethers with 1 to 4 ethylene glycol ether radicals in the molecule, which are not soluble or not completely soluble in water, particularly if they are used together with water-soluble, non-ionic or anionic surface-active substances.

Furthermore the water-soluble, addition products of ethylene oxide, which contain 20 to 250 ethylene glycol ether groups and 10 to 100 propylene glycol ether groups, adducted onto polypropylene glycol ("Pluronics"), alkylene diamine polypropylene-glycol ("Tetronics"), and alkyl polypropylene glycols with 1 to 10 carbon atoms in the alkyl chain can also be used, where the polypropylene glycol chain acts as a hydrophobic radical.

Further useful Nonionics are fatty acid alkylolamides or sulfonic acid alkylolamides, derived, for example, from mono- or diethanolamine, from dihydroxypropyl amine or other polyhydroxyalkyl amines, such as the glycamines. Also the oxides of higher tertiary amines with a hydrophobic alkyl residue and two shorter alkyl and/or alkylol residues, with up to 4 carbon atoms each, can be considered as Nonionics.

The foaming power of the tenside can be increased or reduced by combination of suitable tenside types, as well as changed by additions of non-surface-active organic substances.

Suitable foam stabilizers, particularly with anionic sides of the sulfonate or sulfate type, are surface-active carboxy or sulfo betaines, as well as the above-named nonionics of the alkylolamide type. Moreover, fatty alcohols or higher terminal diols have been suggested for this purpose.

A reduced foaming power, that is desirable for the use in washing machines, is often attained by combination of different tenside types, such as of sulfates and/or sulfonates and/or of nonionics, on the one hand, with soaps, on the other hand. In soaps, the foam inhibition with the degree of saturation and the number of carbons in the fatty acid residue. Soaps derived from saturated $C_{20-24}$ fatty acids have been proven good as foam inhibitors.

The non-tenside foam inhibitors included N-alkylated aminotriazines, optionally containing chlorine, which are obtained by the reaction of 1 mol of cyanuric acid chloride with 2 to 3 mols of a mono- and/or dialkylamine with 6 to 20, preferably 8 to 18 carbon atoms in the alkyl radicals. Similarly effective are propoxylated and/or butoxylated aminotriazines, such as, products that are obtained by the addition of from 5 to 10 mols of propylene oxide to 1 mol of melamine and further addition of from 10 to 50 mols of butylene oxide to this propylene-oxide derivative.

Other non-tenside foam inhibitors are water-insoluble organic compounds, such as paraffins or halogenated paraffins with melting points below 100°C, aliphatic $C_{18}$ to $C_{40}$ ketones as well as aliphatic carboxylic acid esters which contain in the acid or alcohol residue, optionally also in both of these residues, at least 18 carbon atoms (such as triglyceride or fatty acid/fatty alcohol esters). These compounds can be used for the inhibition of foam, above all in combinations of tensides of the sulfate and/or sulfonate type with soaps.

As particularly low-foaming nonionics which can be used both alone, and also in combination with the abovementioned anionic, and nonionic tensides and to reduce the foaming power of better foaming tensides, the addition products of propylene oxide to the above-described surface-active polyethyleneglycol ethers are suitable as well as the addition products ethylene oxide with the above-described polypropylene glycols, alkylenediamine polypropylene glycols or the $C_{1-10}$-alkyl polypropylene glycols.

All weakly acidic, neutral and alkaline reacting inorganic or organic salts, particularly the alkali metal salts of compounds which can precipitate or sequester calcium ions, are suitable as builders in combination with the phosphonopolycarboxylates.

Weakly acidic, neutral or alkaline reacting salts which are usable are, for example, the bicarbonates, carbonates, or silicates of the alkali metals, such as sodium silicates with a $Na_2O:SiO_2$ ratio of from 1:1 to 1:3.5. The alkali metal sulfates and borates are also suitable.

Among the suitable organic salts, that is the alkali metal salts of organic acid compounds, are the non-surface-active sulfonic acid, carboxylic acid and sulfocarboxylic acid salts containing from 1 to 8 carbon atoms, for example, the alkali metal salts of benzenesulfonic acid, toluenesulfonic acid or xylenesulfonic acid, sulfobenzoic acid, sulfophthalic acid, sulfoacetic acid, sulfosuccinic acid or other sulfocarboxylic acids, as well as the alkali metal salts of acetic acid or lactic acid.

Other suitable builder salts are the nitrogen and phosphorus free compounds of the type of the polycarboxylic acids or their alkali metal salts which form complexing salts with calcium ions. This type also includes polymers containing carboxyl groups. Suitable are, for example citric acid, tartaric acid, benzene-hexacarboxylic acid, polycarboxylic acids containing carboxymethylether groups such as diglycolic acid, 2,2'-oxydisuccinic acid, as well as polyhydric alcohols or polyhydroxycarboxylic acids partly or completely etherified with glycolic acid, for example, bis(O-carboxymethyl)-ethylene glycol, mono or bis-(O-carboxymethyl) glyceric acid, or carboxymethylated or oxidized polysaccharides. Suitable are also the polymeric carboxylic acids with a molecular weight of at least 350, such as polyacrylic acid, poly-$\alpha$-hydroxyacrylic acid, polymaleic acid, etc., as well as the water-soluble salts, such as the alkali metal salts of copolymers of maleic acid anhydride with ethylene, propylene or vinylmethyl ether and the practically uncrosslinked polyhydroxycarboxylic acids and polyaldehydecarboxylic acids containing C—C bonds in the principal chain, which are composed substantially of ethylene units with one carboxylformyl-, hydroxymethyl or hydroxyl group each. The polyhydroxycarboxylic acids have a ratio of carboxyl groups to hydroxyl groups of 1.1 to 15, preferably 2 to 9, and a degree of polymerization of preferably 3 to 600 units. They can be produced, for example, by copolymerization of acrolein and acrylic acid in the presence of hydrogen peroxide and subsequent Cannizzaro reaction.

The polyaldehydecarboxylic acids have a ratio of carboxyl to formyl groups of at least 1, and a degree of polymerization of preferably 3 to 100 units, optionally the polymers have terminal hydroxyl groups. They can be produced, for example, by oxidative-polymerization of acrolein with hydrogen peroxide.

The ingredients of the washing agents and washing auxiliaries of the invention, particularly the builders are mostly so selected, that the preparations react weakly acidic to distinctly alkaline in aqueous solution. Preferably, the pH-value of a 1% solution of the preparation mostly lies in the range from 6 to a maximum of 11.5. Fine-washing and low temperature washing agents have mostly a weakly acidic to weakly alkaline reaction (pH-value = 6 to 9.5), while soaking pre-washing and boiling-washing agents are more strongly alkaline (pH-value = 9.5 to 11.5, preferably 10 to 11).

Soil-suspension agents which keep the dirt, loosened from the fiber, suspended in the liquor, and thus preventing graying, can also be utilized in the washing agents and washing auxiliaries of the invention. For this, water-soluble colloids, mostly organic in nature, are suitable, such as this water-soluble salts of polymeric carboxylic acids, glue, gelatins, salts of ethercarboxylic acids or ethersulfonic acids of starch or cellulose or salts of acidic sulfuric acid esters of cellulose or starch. Also water-soluble polyamides, containing acidic groups, are suitable for this purpose. Furthermore, soluble starch preparations and starch products other than the above-named, such as degraded starch, aldehyde starches, etc. may be used. Also polyvinylpyrrolidone is usable. Soil suspension properties are also found in the addition products of 1 to 4 mols of ethylene oxide adducted onto 1 mol of fatty alcohol with 8 to 18 carbon atoms, described above a non-ionic surface-active compound.

Among the compounds serving as bleaching agents, releasing $H_2O_2$ in water, sodium perborate tetrahydrate ($NaBO_2.H_2O_2.3\ H_2O$) and the monohydrate ($NaBO_2.H_2O_2$) have particularly practical importance. But also other $H_2O_2$ releasing borates are usable, such as perborax $Na_2B_4O_7.4H_2O$. These compounds may partly or completely be replaced by other carriers of active oxygen, particularly by peroxyhydrates, such as percarbonates, ($Na_2CO_3.1.5H_2O_2$), peroxypyrophosphates, citrate perhydrate, percarbamide, (urea-$H_2O_2$) or melamine $H_2O_2$ compounds as well as by $H_2O_2$ releasing peracidic salts, such as caroates ($KHSO_5$), perbenzoates or perphthalates.

It is recommended to incorporate conventional water-soluble and/or water-insoluble stabilizers for percompounds in amounts from 0.25% to 10% by weight. Water-insoluble percompound stabilizers, which amount to, for example, from 1% to 8%, preferably 2% to 7% of the weight of the whole preparation, are, for example, the magnesium silicates, mostly obtained by precipitation from aqueous solutions, MgO : $SiO_2$ = 4:1 to 1:4, preferably 2:1 to 1:2 particularly 1:1. In their place, other alkaline earth metal, cadmium or tin silicates of a corresponding composition are usable. Also water containing oxides of tin are suitable as stabilizers. Water-soluble stabilizers which may be present together with the water-insoluble ones, are the organic sequestering agents whose quantity may amount to 0.25% to 5%, preferably 0.5% to 2.5% of the weight of the whole preparation.

In order to obtain a satisfactory bleaching effect when washing at temperatures below 80°C, particularly in a range of 60°C to 40°C, bleach activator components are preferably incorporated in the preparations.

Certain N-acyl-O-acyl compounds, forming with the $H_2O_2$ organic peracids, as well as carbonic acid or pyrocarbonic acid esters, whose activation value for the percompounds ( = titer) is at least 3, preferably at least 4.5 serve as activators for the percompounds, releasing $H_2O_2$ in water. This activation value is determined in the following manner.

Solutions that contain 0.615 gm/liter of $NaBO_2.H_2O_2.3H_2O$ (4 m mol/liter) and 2.5 gm/liter of $Na_4P_2O_7.10\ H_2O$ are treated, after heating to 60°C, with 4 m mol/liter of activator and kept for 5 minutes at this temperature with stirring. Then 100 ml of this liquid is added to a mixture of 250 gm of ice and 15 ml of glacial acetic acid and titrated, immediately after the addition of 0.35 gm of potassium iodide, with 0.1N sodium thiosulfate solution with starch as indicator. The amount of thiosulfate solution used in ml is the activation value ( = titer). At a 100% activation of the peroxide used, it would amount to 8.0 ml.

Of the types of activators described below, particularly those compounds are suitable which have a melting point of at least 70°C, preferably at least 100°C, and especially at least 150°C. Furthermore, the equivalent weight of these compounds (under equivalent weight is here understood the quotient from the molecular weight and the number of acyl residues, or carbonic acid or pyrocarbonic acid residues in the molecule) should be at most 170, preferably at most 130 and especially at most 110.

The activators, usable according to the invention, include:

a. the N-diacylated and N,N'-tetraacylated amines, such as N,N,N',N'-tetraacetyl-methylenediamine, N,N,N',N'-tetraacetyl-ethylenediamine, N,N-diacetylaniline and N,N-diacetyl-p-toluidine or 1,3-diacylated hydantoins, such as the compounds 1,3-diacetyl-5,5-dimethylhydantoin and 1,3-dipropionylhydantoin;

b. the N-alkyl-N-sulfonyl-carbonamides, for example, the compounds N-methyl-N-mesyl-acetamide, N-methyl-N-mesyl-benzamide, N-methyl-N-mesyl-p-nitrobenzamide and N-methyl-N-mesyl-p-methoxybenzamide;

c. the N-acylated cylic hydrazides, acylated triazoles or urazoles, such as the monoacetylmaleic acid hydrazide;

d. the O,N,N,-tri-substituted hydroxyl amines, such as O-benzoyl-N,N-succinylhydroxylamine, O-acetyl-N,N-succinylhydroxylamine, O-p-methoxybenzoyl-N,N-succinylhydroxylamine, O-p-nitrobenzoly-N,N-succinylhydroxylamine and O,N,N-triacetylhydroxylamine;

e. the N,N-diacyl-sulfurylamides, such as N,N-dimethyl-N,N'-diacetyl-sulfurylamide and N,N'-diethyl-N,N'-dipropionyl-sulfurylamide;

f. the triacylcyanurates, such as triacetylcyanurate and tribenzoylcyanurate;

g. the carboxylic acid anhydrides, such as benzoic acid anhydride, m-chlorobenzoic acid anhydride, phthalic acid anhydride, 4-chlorophthalic acid anhydride;

h. the sugar esters, such as glucosepentaacetate;

i. the 1,3-diacyl-4,5-diacyloxy-imidazolidines, such as the compounds 1,3-diformyl-4,5-diacetoxyimidazolidine, 1,3-diacetyl-4,5-diacetoxy-imidazolidine, 1,3-diacetyl-4,5-dipropionyloxy imidazolidine;

j. the acylated glycoluril compounds, such as tetraacetylglycoluril and tetrapropionylglycoluril;

k. the diacylated 2,5-diketopiperazines, such as 1,4-diacetyl-2,5-diketo-piperazine, 1,4-dipropionyl-2,5-diketo-piperazine, 1,4-dipropionyl-3,6-dimethyl-2,5-diketo-piperazine.

l. the acylation products of propylenediurea or 2,2-dimethylpropylenediurea (2,4,6,8-tetraaza-bicyclo-(3,3,1)-nonane-3,7-dione or its 9,9-dimethyl derivative), particularly tetraacetyl-propylenediurea, tetrapropionyl-propylenediurea or their dimethyl derivatives;

m. the carbonic acid esters, for example, the sodium salts of p-(ethoxycarbonyloxy)-benzoic acid and p-(propoxycarbonyloxy)-benzenesulfonic acid.

Of particularly practical interest are the activator types named under (a), (j), (k) and (l).

In the activation of the percompounds by the above-named N-acyl-and O-acyl compounds, carboxylic acids, such as acetic acid, propionic acid, benzoic acid, are liberated, and it is recommended to add corresponding amounts of alkalis to neutralize these carboxylic acids. In effective activators, an activation is visible already in using amounts of 0.05 mols of activator per gm-atom of active oxygen. Preferably 0.1 to 1 mol of activator are used. The amount may, however, be raised up to 2 mols of activator per gm-atom of active oxygen if desired.

The washing agents and washing auxiliaries can also contain optical brighteners. The optical brighteners which can be utilized in the compositions are mostly, if not exclusively, derivatives of aminostilbenesulfonic acid, or of diaminostilbenedisulfonic acid, of diarylpyrazolines, of carbostyril, of 1,2-di-(2-benzoxazolyl)-ethylene or 1,2-di-(2-benzimidazoyl)-ethylene, of benzoxazolyl-thiophene and of the coumarins.

Examples of brighteners from the class of the diaminostilbenedisulfonic acid derivatives and their alkali metal salts are compounds, according to formula I:

I:

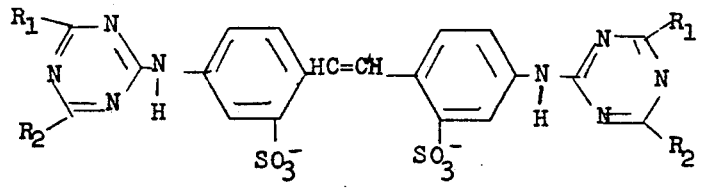

In the formula, $R_1$ and $R_2$ represent alkoxy, amino, or residues of aliphatic, aromatic or heterocyclic, primary or secondary amines as well as residues of aminosulfonic acids, where the aliphatic residues present in the above groups, contain preferably 1 to 4 and particularly 2 to 4 carbon atoms, while the heterocyclic ring systems are mostly 5 to 6 membered rings. As aromatic amines the residue of the aniline, of the anthranilic acid or the anilinesulfonic acid are preferred. Brighteners, derived from the diaminostilbenedisulfonic acid, are mostly used as cotton brighteners. The following products, derived from formula I, are commercially available, where $R_1$ represents the residue $-NHC_6H_5$ and $R_2$ may represent the following residues:

$-NH_2$, $-NHCH_3$, $NHCH_2CH_2OH$, $-NHCH_2CH_2OCH_3$, $-NHCH_2CH_2CH_2OCH_3$, $-N(CH_3)CH_2CH_2OH$, $-N(CH_2CH_2OH)_2$, morpholino-, $-NHC_6H_5$, $-NHC_6H_4SO_3H$, $-OCH_3$. Some of these brighteners are, in regard to their fiber affinity, regarded as transitional types to the polyamide brighteners such as the brightener with $R_2 = -NHC_6H_5$. The compound 4,4'-bis-(4-phenyl-1,2,3-triazo13-2-yl)-2,2'-stilbenedisulfonic acid belongs also to the cotton brighteners of the diaminostilbenedisulfonic acid type.

Diarylpyrazolines of the formulae II and III belong to the polyamide brighteners.

II:

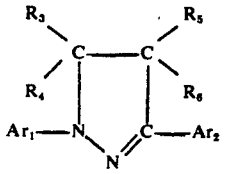

III:

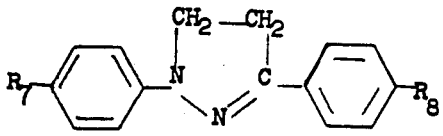

In the formula II $R_3$ and $R_5$ represent hydrogen, alkyl and aryl, optionally substituted by carboxyl, carbonamide or carboxylic acid ester groups, $R_4$ and $R_6$ represent hydrogen or lower alkyl, $Ar_1$ and $Ar_2$ represent aryl radicals, such as phenyl, diphenyl or naphthyl, which may carry further substituents, such as hydroxy, alkoxy, hydroxyalkyl, amino, alkylamino, acylamino, carboxyl, carboxylic acid esters, sulfonic acid, sulfonamide and sulfone groups or halogen atoms. Commercially available brighteners of this type are derived from the formula III, where the radical $R_7$ may represent the groups Cl, $-SO_2NH_2$, $-SO_2CH{=}CH_2$, and $-COOCH_2CH_2OCH_3$, while $R_8$ mostly represents a chlorine atom. Also the 9-cyanoanthracene belongs to the polyamide brighteners.

The polyamide brighteners further include aliphatically or aromatically substituted aminocoumarins, such as 4-methyl-7-dimethylamino-coumarin or 4-methyl-7-diethylaminocoumarin. Further usable as polyamide brighteners are the compounds 1-(2-benzimidazolyl)-2-(1-hydroxyethyl-2-benzimidazolyl)-ethylene and 1-ethyl-3-phenyl-7-diethylamino-carbostyril. Suitable as brighteners for polyester and polyamide fibers are the compounds 2,5-di-(2-benzoxazolyl)-thiophene, 2-(2-benzoxazolyl)-naphtho-[2,3-b]-thiophene, and 1,2,-di-(5-methyl-2-benzoxazolyl)-ethylene. Furthermore brighteners of the type of the substituted 4,4'-distyryl diphenyl can be present, for example, the compound 4,4'-bis(4-chloro-3-sulfostyryl)-diphenyl. Mixtures of the above mentioned brighteners can also be used.

The enzyme preparations to be used are mostly a mixture of enzymes with different effects, such as proteases, carbohydrases, esterases, lipases, oxidoreductases, catalases, peroxidases, ureases, isomerases, lyases, transferases, desmolases, or nucleases. Of particular interest are the enzymes, obtained from bacteria strains or from fungi, such as Bacillus subtilis or Streptomyces griseus, particularly proteases and amylases, which are relatively stable towards alkalis, percompounds, and anionic tensides and are still effective at temperatures up to 70°C.

Enzyme preparations are marketed by the manufacturers mostly as aqueous solutions of the active substances or as powders, granulates or as cold-sprayed products. They frequently contain sodium sulfate, sodium chloride, alkali metal ortho-, pyro- and polyphosphates, particularly tripolyphosphate, as fillers. Dust-free preparations are particularly valued. These are obtained in a known manner by incorporating of oily or pasty Nonionics or by granulation with the aid of melts of water-of-crystallization containing salts in their own water-of-crystallization.

Enzymes may be incorporated which are specific for certain types of soil, for example, proteases or amylases or lipases. Preferably, combinations of enzymes with different effects are used, particularly combinations of proteases and amylases.

EXAMPLES

The following examples describe compositions of some washing agents and washing auxiliaries according to the invention.

The salt-like ingredients, contained in the agents of the examples, such as salt-like tensides, other organic salts, including the phosphonopolycarboxylate, as well as inorganic salts, are present as the sodium salts, unless expressively stated as otherwise. The notations or abbreviations used have the following meanings:

"ABS" – the salt of an alkylbenzenesulfonic acid with 11 to 13 carbon atoms in the alkyl chain, obtained by condensation of straight-chain olefins with benzene and sulfonation of the thus-formed alkylbenzene.

"Alkanesulfonate" – a sulfonate obtained from paraffins with 12 to 16 carbon atoms by sulfoxidation, "Fs-estersulfonate" – a sulfonate obtained from the methyl ester of a hardened tallow fatty acid, by sulfonation with $SO_3$, "CA-sulfate" or "TA-sulfate" – the salts of sulfated, substantially saturated fatty alcohols, prepared by reduction of coconut fatty acid or tallow fatty acid respectively, "Soap" – the salts derived from fatty acid mixtures of an iodine number of 3, whose composition was 9% by weight of $C_{18}$, 14% by weight of $C_{20}$, and 77% by weight of $C_{22}$.

"OA + 10 EO" – the addition product of ethylene oxide (EO) to technical oleyl alcohol (OA) whereby the numbers signify the molar amount of ethylene oxide, added to 1 mol of alcohol.

"EDTA" or "HEDP" – the salts of ethylenediaminetetraacetic acid or hydroxyethanediphosphonic acid, "Perborate" – a product of the approximate composition $NaBO_2.H_2O_2.3\ H_2O$, containing about 10% of active oxygen, "CMC" – the salt of carboxymethylcellulose.

As foam inhibitor, a mixture of about 45% of a di-(alkylamino)-monochlorotriazine and about 55% of a N,N',N''-trialkylmelamine was used. In all these triazine derivatives the alkyl residues were present as mixtures of homologs with 8 to 18 carbon atoms. With a similar success also the monochlorotriazine derivative or the trialkylmelamine can be used. If the described products contained synthetic sulfates or sulfonates together with soap, the other non-tenside foam inhibitors named in the specification, could be utilized, such as paraffin oil or paraffin. In the preparation of the products, the foam inhibitor used was sprayed in the molten state, with the aid of a nozzle, onto the moving powdery preparation.

EXAMPLE 1

| Percent by Weight | Full Detergent |
|---|---|
| 24.0 | 1-Phosphonobutane-2,3,4-tricarboxylic acid |
| 5.5 | ABS |
| 2.2 | TA sulfate |
| 1.5 | CA sulfate |
| 0.2 | EDTA |
| 6.0 | $Na_2O.3.3\ SiO_2$ |
| 27.0 | Perborate |
| 2.0 | $MgSiO_3$ |
| 0.3 | Cotton brightener |
| 1.5 | CMC |
| 0.6 | Non-surface-active foam inhibitor |

EXAMPLE 1-continued

| Percent by Weight | Full Detergent |
|---|---|
| Balance | Sodium sulfate and water |

EXAMPLE 2

| Percent by Weight | Full Detergent |
|---|---|
| 5.0 | 2-Phosphonobutane-1,2,4-tricarboxylic acid |
| 2.5 | OA + 10 EO |
| 6.0 | Fs-estersulfonate |
| 2.0 | Soap |
| 0.3 | HEDP |
| 15.0 | $Na_2CO_3$ |
| 5.0 | $Na_2O.3.3\ SiO_2$ |
| 15.0 | Perborate |
| 1.0 | $MgSiO_3$ |
| 5.0 | Tetraacetyl glycoluril |
| 0.5 | Cotton brightener |
| 1.2 | CMC |
| 0.4 | Non-surface-active foam inhibitor |
| Balance | Sodium sulfate and water |

EXAMPLE 3

| Percent by Weight | Full Detergent |
|---|---|
| 15.0 | 2-Phosphonopropane-2,3-dicarboxylic acid |
| 8.5 | Fs-estersulfonate |
| 4.0 | TA sulfate |
| 2.0 | Soap |
| 5.5 | $Na_2O.3.3\ SiO_2$ |
| 26.0 | Perborate |
| 1.0 | $MgSiO_3$ |
| 0.6 | Cotton brightener |
| 1.6 | CMC |
| 0.2 | Non-surface-active foam inhibitor |
| Balance | Sodium sulfate and water |

EXAMPLE 4

| Percent by Weight | Full Detergent |
|---|---|
| 15.0 | 1-Phosphonoethane-1,2-dicarboxylic acid |
| 10.0 | Alkanesulfonate |
| 2.5 | OA + 10 EO |
| 3.5 | Soap |
| 1.2 | EDTA |
| 8.0 | $Na_2CO_3$ |
| 8.0 | $Na_2O.3.3\ SiO_2$ |
| 26.5 | Perborate |
| 1.0 | $MgSiO_3$ |
| 0.3 | Cotton brightener |
| 0.8 | CMC |
| 0.2 | Non-surface-active foam inhibitor |
| Balance | Sodium sulfate and water. |

EXAMPLE 5

| Percent by Weight | Full Detergent |
|---|---|
| 0.75 | 2-Phosphonobutane-1,2,4-tricarboxylic acid |
| 18.0 | Fs-ester sulfonate |
| 4.0 | ABS |
| 2.5 | OA + 10 EO |
| 3.5 | EDTA |
| 10.0 | $Na_2O.3.3\ SiO_2$ |
| 20.0 | $Na_2CO_3$ |
| 30.0 | Perborate |
| 1.5 | $MgSiO_3$ |
| 1.2 | CMC |
| 0.5 | Non-surface-active foam inhibitor |
| 0.4 | Cotton brightener |

EXAMPLE 5-continued

| Percent by Weight | Full Detergent |
|---|---|
| Balance | Sodium sulfate and water |

EXAMPLE 6

| Percent by Weight | Prewashing Agent |
|---|---|
| 3.0 | 1-Phosphonopropane-1,2,3-tricarboxylic acid |
| 5.0 | OA + EO |
| 10.0 | $Na_2O.3.3\ SiO_2$ |
| 15.0 | $Na_2CO_3$ |
| 1.0 | CMC |
| 2.3 | Enzymes |
| Balance | Sodium sulfate and water. |

EXAMPLE 7

| Percent by Weight | Fine Washing Agent |
|---|---|
| 10.0 | 2-Phosphonobutane-2,3,4-tricarboxylic acid |
| 1.5 | CA sulfate |
| 1.5 | TA sulfate |
| 8.0 | Fs-estersulfonate |
| 3.0 | OA + 10 EO |
| 3.0 | Soap |
| 5.0 | $NaHCO_3$ |
| 8.0 | $Na_2CO_3$ |
| 0.3 | Cotton brightener |
| 0.2 | Polyamide brightener |
| Balance | Sodium sulfate and water. |

The preparations according to Example 1 to 7 have a pH value of under 11.5 in 1% aqueous solution.

The detergents and washing aids according to the invention have a substantially lower phosphorus content than corresponding preparations based on sodium tripolyphosphate. Particularly when washing in hard water, incrustations on the laundry and deposits on washing machine parts can be avoided by using the preparations according to the invention.

If the perborate-containing agents, particularly those to be utilized below 80°C (after-rinsing agents), are compounded with activators for percompounds, for example, with tetraacetylglycoluril, tetraacetylmethylenediamine or tetraacetylethylenediamine, a good bleaching effect is obtained also at temperatures of from 20° to 70°C.

The preceding examples are illustrative of the practice of the invention. It is to be understood, however, that other expedients known to those skilled in the art or disclosed herein, may be employed without departing from the spirit of the invention or the scope of the appended claims.

We claim:

1. Washing agent compositions and washing assistant compositions comprising essentially of (a) from 0.5% to 70% by weight of a phosphonopolycarboxylate having the formula

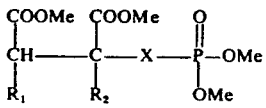

wherein $R_1$ is a member selected from the group consisting of hydrogen and methyl, $R_2$ is a member selected from the group consisting of hydrogen, alkyl having 1 to 4 carbon atoms and $—CH_2—CHR_1—COOMe$, X is a member selected from the group consisting of (1) a direct bond between the carbon and the phosphorus,

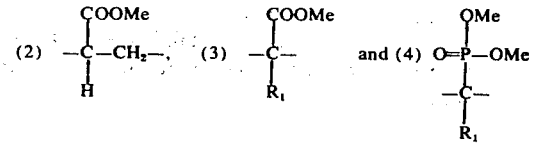

and Me is a member selected from the group consisting of hydrogen and a cation capable of complex formation with alkaline earth metal ions, (b) from 0 to 96.5% by weight of customary non-surface-active ingredients for washing agents and (c) from 3% to 45% by weight of at least one surface-active compound selected from the group consisting of soaps, synthetic carboxylates, sulfates, sulfonates and nonionic polyglycol ethers, wherein the components are so selected that a 1% solution of said compositions has a pH of between 6 and 11.5 and the total content of phosphorus does not exceed 4% by weight.

2. The composition of claim 1 wherein said phosphonocarboxylate has a maximum of three carboxyl groups.

3. The composition of claim 1 wherein the components are so selected that a 1% aqueous solution of the composition has a pH of between 7 and 11.

4. The composition of claim 1 wherein the components are so selected that the total content of phosphorus does not exceed 2% by weight.

5. The composition of claim 1 wherein said component (b) includes an alkali metal salt selected from the group consisting of carbonates and silicates, and the weight ratio of said phosponopolycarboxylate to said alkali metal salt is between 1:100 and 4:1.

6. The composition of claim 1 wherein said component (b) includes an alkali metal salt selected from the group consisting of carbonates and silicates, and the weight ratio of said phosphonopolycarboxylate to said alkali metal salt is between 1:50 and 4:1.

7. The composition of claim 1 wherein said component (b) includes an alkali metal salt selected from the group consisting of carbonates and silicates, and the weight ratio of said phosphonopolycarboxylate to said alkali metal salt is 1:20 and 1:1.

8. The composition of claim 1 containing from 5% to 40% by weight of said surface-active components (c), from 20% to 90% by weight of builder components (b) selected from the group consisting of organic builder salts and inorganic non-sequestering builder salts free from phosphorus and nitrogen and from 10% to 80% by weight of said phosphonopolycarboxylate sequestering agent capable of sequestering alkaline earth metal ions, said compositions having a pH in a 1% aqueous solution of from 6 to 11.5.

9. The composition of claim 8 wherein said surfaceactive component (c) includes from 0.5% to 6% by weight of the component (c) of foam stabilizers and from 0.5 to 8% by weight of the component (c), of non-surface-active foam inhibitors.

10. The composition of claim 8 wherein said surface-active component (c) has the following composition:

25% to 75% by weight of anionic surface-active compounds selected from the group consisting of sulfonates and sulfates, 10% to 50% by weight of soap where the ratio of (sulfonates + sulfates) to soap is between 5:1 and 1:2, 5% to 40% by weight of non ionic polyglycol ethers surface-active compounds, 0.5% to 3% by weight of foam stabilizers, and 0.5% to 5% by weight of non-surface-active foam inhibitors.

11. The composition of claim 8 wherein said builder component (b) includes from 15% to 40% by weight of the composition of a bleaching component selected from the group consisting of percompounds, and their mixtures with bleach activators and stabilizers.

12. The composition of claim 8 including a further content of from 0.1% to 5% of soil-suspending agents, from 0 to 5% by weight of enzymes selected from the group consisting of proteases, lipeases and amylases, and from 0 to 1% by weight of an optical brightener.

* * * * *